United States Patent [19]

Steere, Jr.

[11] Patent Number: 5,076,021

[45] Date of Patent: Dec. 31, 1991

[54] FLAT GRIND STAGE ASSEMBLY FOR AN AUTOMATIC EDGE GRINDER

[75] Inventor: Robert E. Steere, Jr., Boonton, N.J.

[73] Assignee: Silicon Technology Corporation, Oakland, N.J.

[21] Appl. No.: 345,627

[22] Filed: Apr. 28, 1989

[51] Int. Cl.[5] ..... B24B 5/00; B24B 17/00; B24B 49/00; B24B 9/06

[52] U.S. Cl. ..... 51/105 R; 51/283 E; 51/165.71; 51/35

[58] Field of Search ..... 51/165.71, 165.8, 283 E, 51/34 C, 34 D, 34 E, 106 R, 106 LG, 105 R, 105 LG, 284 E, 281 R, 267, 35, 50, 51, 60, 165.77, 103 R, 165.74

[56] References Cited

U.S. PATENT DOCUMENTS

| | | | |
|---|---|---|---|
| 3,971,168 | 7/1976 | Nishimura | 51/165.8 |
| 4,344,260 | 8/1982 | Ogiwara | 51/283 E |
| 4,502,459 | 3/1985 | Dyer | 51/267 X |
| 4,558,686 | 12/1985 | Ono | 51/267 X |
| 4,594,814 | 6/1986 | Olszewski | 51/283 E X |
| 4,638,601 | 1/1987 | Steere | 51/165.71 |
| 4,864,779 | 9/1989 | Ozaki | 51/283 E |

FOREIGN PATENT DOCUMENTS

| | | | |
|---|---|---|---|
| 3334581 | 4/1985 | Fed. Rep. of Germany | 51/106 LG |

*Primary Examiner*—Frederick R. Schmidt
*Assistant Examiner*—Bruce P. Watson
*Attorney, Agent, or Firm*—Kenyon & Kenyon

[57] ABSTRACT

The flat grind stage assembly is programmed so that the grinding wheel is first caused to move along a straight path to form a flat on a wafer while the wafer is held in a stationary position. Thereafter, the grinding wheel is returned to the mid-point of the flat and then moved away from the flat. The wafer is then rotated and grinding commences when the end of the flat is reached so that a circular periphery is ground on the remainder of the wafer while the axis of the grinding wheel remains stationary.

25 Claims, 4 Drawing Sheets

FLAT GRIND STAGE ASSEMBLY FOR AN AUTOMATIC EDGE GRINDER

This inventions relates to a flat grind stage assembly for an automatic edge grinder.

As is known, various types of machines have been known for the grinding of peripheral edges of wafers, such as silicon wafers, used in the manufacture of semiconductor chips. For example, it has been known from U.S. Pat. No. 4,638,601 to provide a machine with a grinding station in which a wafer may be ground to have a curvilinear profile and a flat. To this end, the grinding station is described as having a grinding wheel programmed to move relative to a rotating chuck so as to form a flat on a wafer held on the chuck while the wafer is rotated. For example, the grinding wheel is first moved towards the rotating wafer and then away from the wafer with the rotation of the wafer and movement of the grinding wheel coordinated in step-like manner so that a straight edge is formed.

However, in some cases, it has been found that the flat which is formed by incremental movement of the grinding wheel towards and then away from the wafer during rotation of the wafer creates an edge with small jags which can be objectional in the further processing of a wafer.

Accordingly, it is an object of the invention to be able to grind a flat on a wafer which has a truly straight edge.

It is another object of the invention to improve the manner of forming a flat on a wafer in a grinding stage of a grinding machine.

It is another object of the invention to provide a simple programmed flat grind stage assembly for a grinder for grinding a flat on a wafer.

It is another object of the invention to provide a relatively simple structure for grinding flats and a curvilinear periphery on wafers.

Briefly, the invention provides a flat grind stage assembly for a grinding machine which includes a holding means for rotating a wafer on a fixed axis and a grinding wheel for grinding a peripheral edge on the wafer. In accordance with the invention, the flat grind stage assembly has a first means for moving the grinding wheel along a first axis or path perpendicular to the fixed axis of the wafer for grinding the edge of the wafer during rotation thereof and a second means for moving the grinding wheel along a second axis or path perpendicular to the first axis/path for grinding at least one flat on the edge of the wafer with the wafer in a stationary position.

The assembly also has a processing means connected with the holding means, first means and second means for actuating the first means and second means to grind the peripheral edge of a rotating wafer into a circular shape with at least one flat. In this respect, the processing means is connected to the holding means in order to stop rotation of the wafer during movement of the grinding wheel along the second axis/path.

The grinding wheel is rotatably mounted in a suitable housing which, in turn, is secured to a carriage. This carriage is, in turn, moved by the second means along a first path to move the grinding wheel along the peripheral edge of a wafer in order to form a flat on the wafer when the wafer is in a stationary position. In addition, the carriage is movable along a second path perpendicular to the first path in order to move the grinding wheel into engagement with the peripheral edge of the wafer during rotation of the wafer in order to form a curvilinear edge on the remainder of the wafer. Where the peripheral edge is to be circular, the grinding wheel may be held in a fixed axis in this path.

A sensor is also provided in a predetermined fixed position relative to the carriage for establishing a "home" position for the carriage. This sensor emits a signal to the processing means in response to the carriage coming into the home position. The processing means is so connected with the holding means for the wafer and the respective means for moving the carriage so that upon receiving a signal from the sensor that the carriage is in the predetermine or "home" position, a grinding operation may initiated. In this respect, the processing means may be programmed so that the carriage is first stopped in the home position and then moved in a plane spaced from and parallel to the central axis of the held wafer so as to form a flat on the wafer. Thereafter, the carriage can be reversed and moved back to a mid-point of the flat, i.e. into alignment with the first axis which should be perpendicular to the flat as well as the fixed axis of the wafer. Next, the means for moving the carriage towards the wafer is actuated to move the grinding wheel away from the wafer, for example, to a stationary position. The wafer is then rotated with the grinding wheel being then brought into engagement with the periphery of the wafer to form a curvilinear periphery thereon.

The processing means may also be programmed to form more than one flat on the wafer and to form a circular periphery or other curvilinear periphery on the wafer.

These and other objects and advantages of the invention will become more apparent from the following detailed description taken in conjunction with the accompanying drawings wherein.

Figure 5:
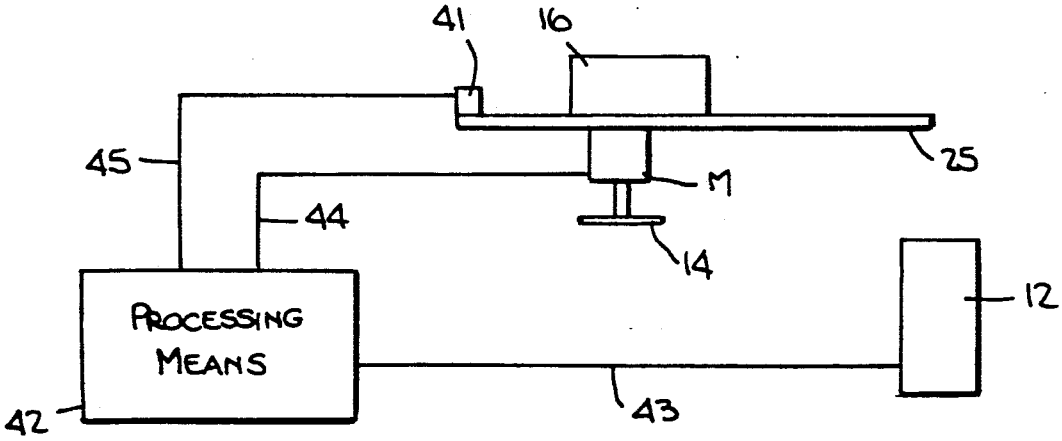
Figure 6:
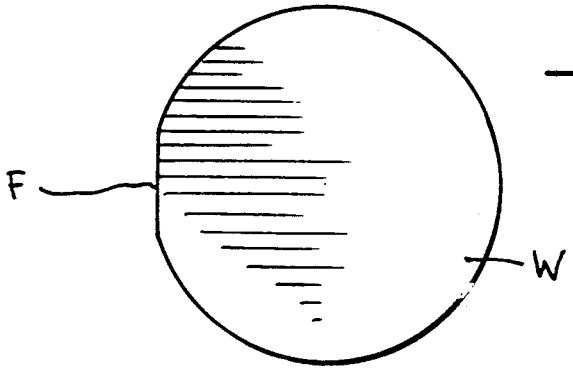

FIG. 5 schematically illustrates a circuit diagram of the connections between the processing means and the elements of the grind stage assembly in accordance with the invention; and FIG. 6 illustrates a wafer with a flat.

Figure 1:
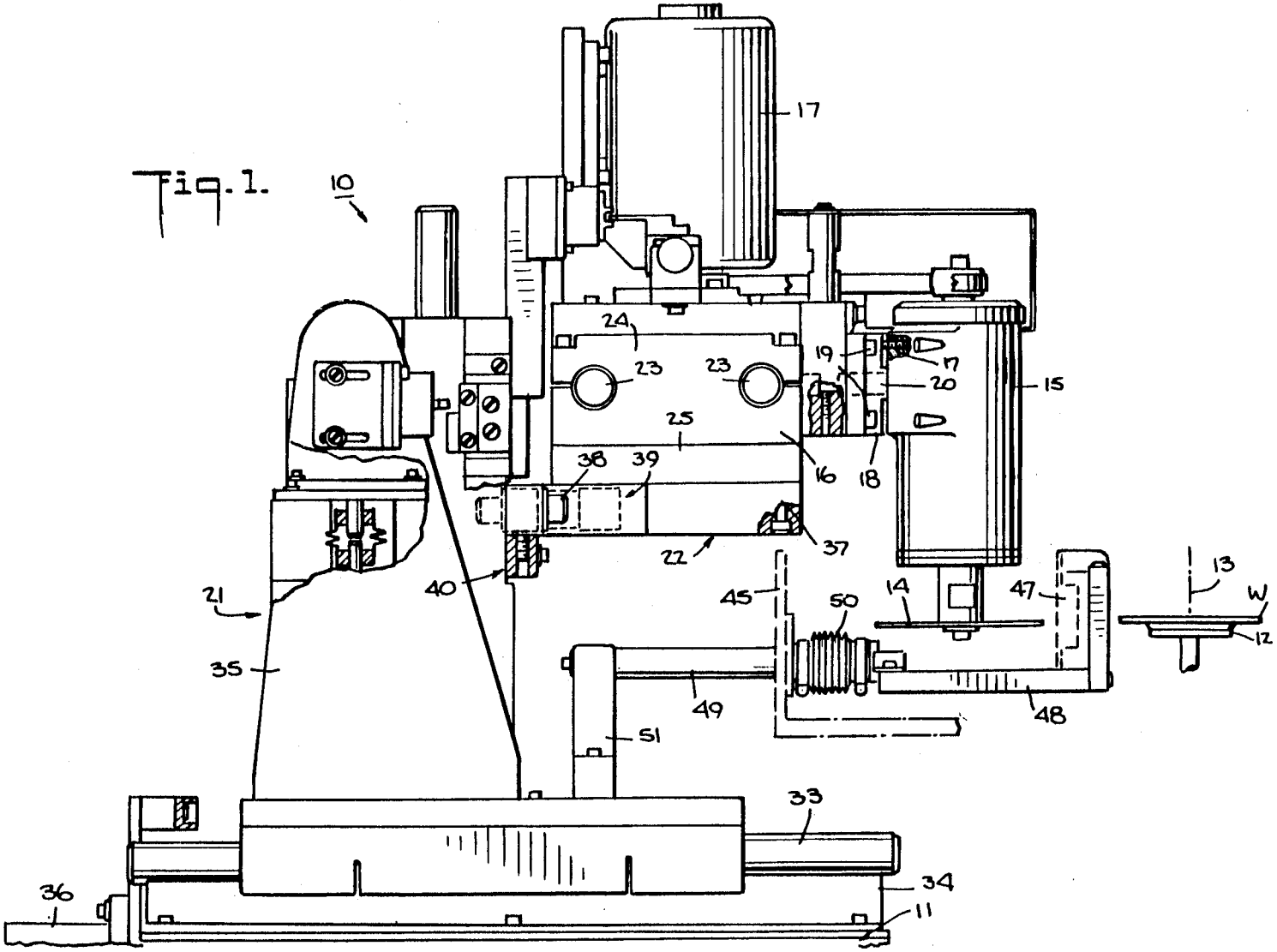
FIG. 1 illustrates a side view of a grinding machine employing a flat grind stage assembly in accordance with the invention.

Referring to FIG. 1, the flat grind stage assembly 10 is part of a grinding machine 11 which serves for the grinding of the peripheral edge of individual wafers into predetermined shapes. The grinding machine is constructed in a manner similar to the grinding machine described in U.S. Pat. No. 4,638,601. Thus, common parts are not further described in detail herein.

As indicated in FIG. 1, the flat grind stage assembly 11 includes a holding means 12, such as a vacuum chuck, for holding and rotating a wafer W about a fixed central axis 13.

In addition, the grind stage assembly 10 has a grinding wheel 14 for grinding a peripheral edge of the wafer W. This grinding wheel 14 is rotatably mounted in a spindle housing 15 and driven by a motor M so as to rotate about a vertical axis parallel to the central axis 13 of the wafer W. The connection between the motor M and the spindle for the grinding wheel 14 is similar to that described in U.S. Pat. No. 638,601.

The spindle housing 15 is in turn secured to a carriage 16 as by bolts 17, for example, a pair of bolts 17 on each side of the housing 15. As indicated, the spindle housing 15 is also engaged with a pivot pin 20 for basic location and support. A registration bar 19 abutting the top edge of the spindle housing 15 serves to precisely align the spindle housing 15 to its original alignment during any subsequent removal and reinstallation. The registration bar 19 is installed only after the initial vertical alignment process is complete. A dummy bar (not shown) with jacking screws is installed during alignment to provide pivotal motion about pin 20 and then removed.

The flat grind stage assembly 10 includes a first means 21 for moving the carriage 16 and, thus the grinding wheel 14 along an axis or path perpendicular to the central axis 13 of the wafer W for grinding the edge of the wafer during rotation thereof as well as a second means 22 for moving the carriage 16 and, thus the grinding wheel 14 along a second axis or path perpendicular to the first path for grinding at least one flat on the edge of the wafer with the wafer in a stationary position.

Figure 2:
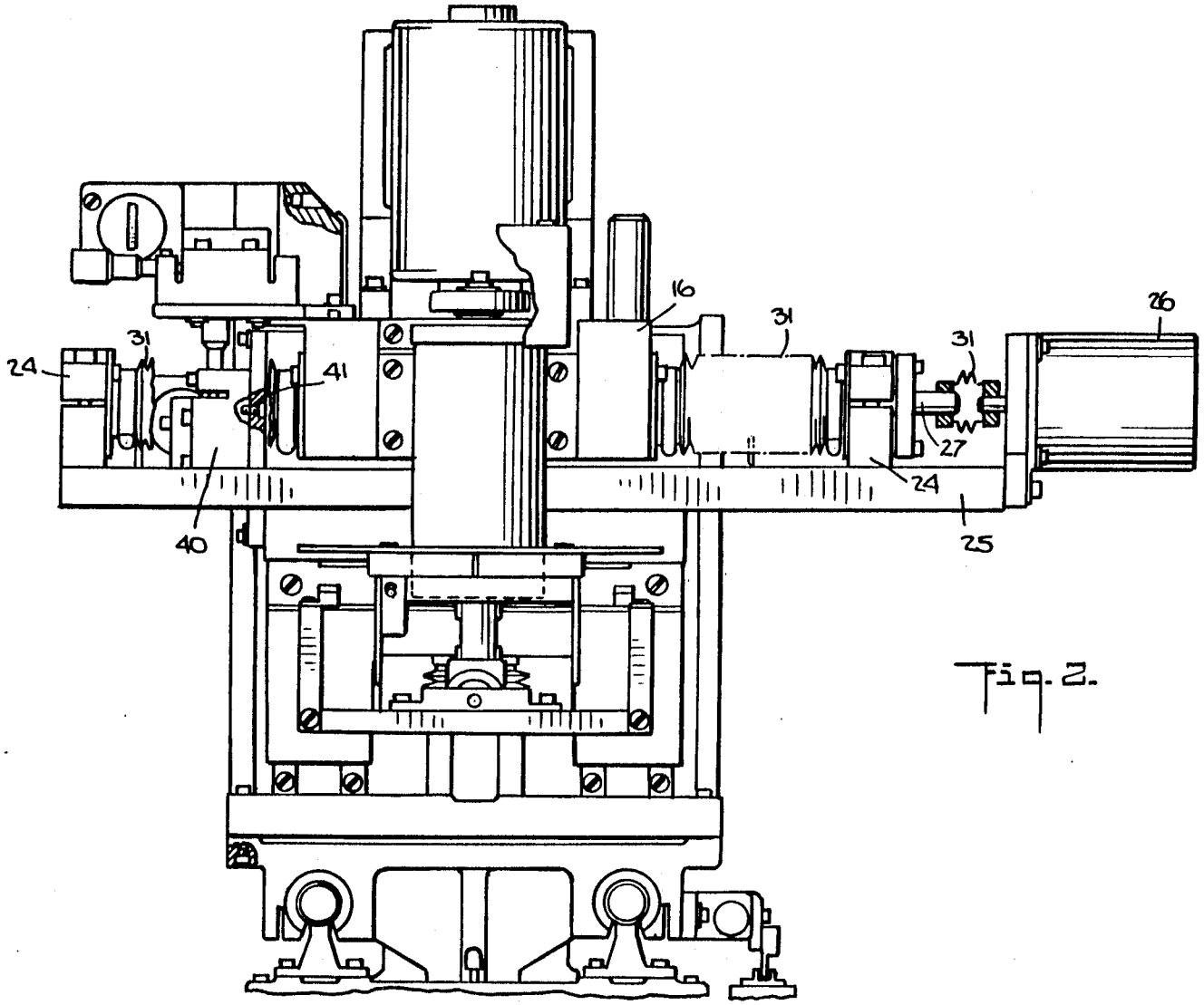
FIG. 2 illustrates a front view of the grind stage assembly of FIG. 1.
Figure 3:
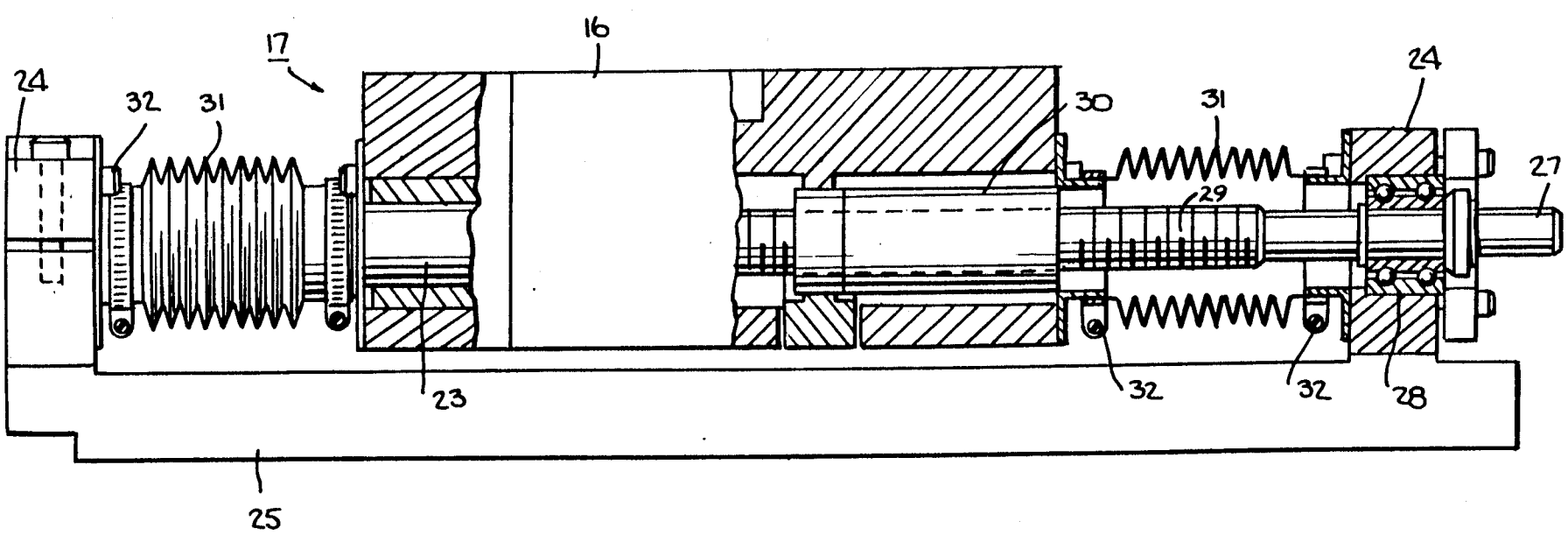
FIG. 3 illustrates a side view of the carriage for mounting the grinding wheel in accordance with the invention.
Figure 4:
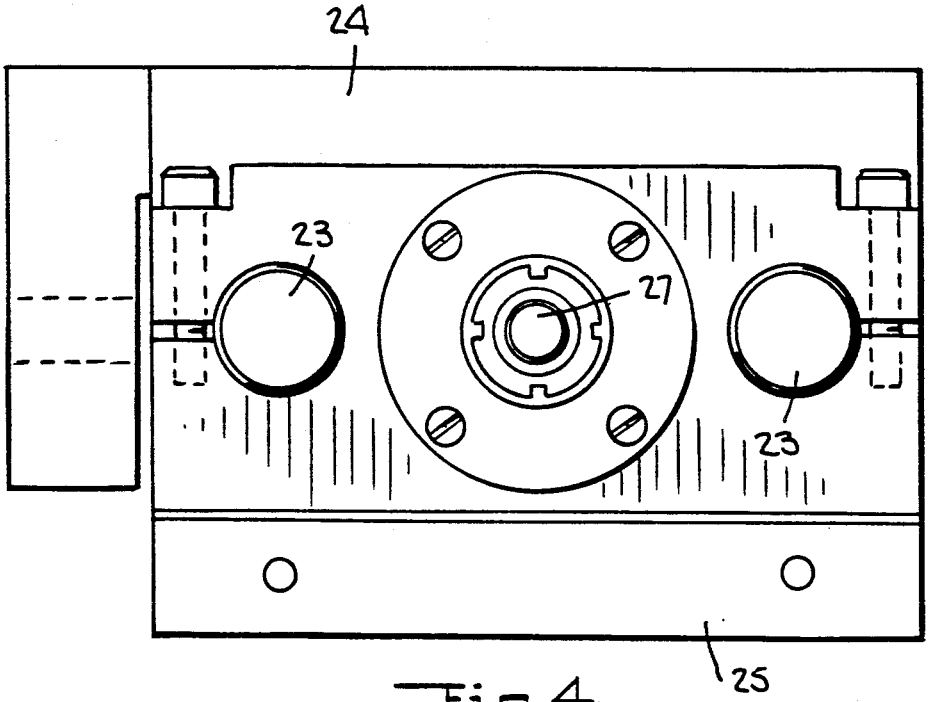
FIG. 4 illustrates an end view of the carriage and related mounting arrangement.

Referring to FIG. 3, means 17 for moving the carriage 16 to form a flat includes a pair of horizontally disposed parallel guide rails 23 for slidably guiding the carriage 16 thereon. As indicated, the guide rails 23 are secured at opposite ends in brackets 24, each of which is secured to a horizontally disposed support plate 25. In addition, a stepper motor 26 (see FIG. 2) is mounted on the plate 25 and is connected to the carriage 16 for moving the carriage 16 along the guide rails 23. To this end, the stepper motor 26 is connected to a rotatable lead screw 27 which is journalled in a suitable bearing 28 in one of the brackets 24 secured to the support plate 25. The screw 27 has a threaded portion 29 received within a threaded sleeve 30 secured within the carriage 16. Thus, upon rotation of the screw 27, the sleeve 30 and carriage 16 are moved linearly along the length of the screw 27.

As indicated, suitable sealing bellows 31 are secured by clamps 32 about the respective guide rails 23 and screw 27 and between the respective brackets 24 and carriage 16. As the carrier 16 moves between the brackets 24, the bellows 31 expand or contract, respectively.

The motor 26 is in the form of a stepper motor which is activated to move the carriage 16 in a continuous mode or in an incremental mode.

Referring to FIG. 1, the means 22 for moving the carriage 16 along a second path towards and away from the central axis 13 of the wafer W is similar to that as described in U.S. Pat. No. 4,638,601. In this respect, the means 22 includes a pair of horizontally disposed parallel support rails 33 fixedly mounted on a frame 34 of the machine 11, a support housing 35 slidably mounted on the rails 33 and a stepper motor 36 connected with the support housing 35 for moving the housing 35 along the rails 33.

As indicated, the carriage 16 is secured to the support housing 35 via a leveling plate 37. To this end, the carriage 16 is secured by suitable bolts (not shown) to the leveling plate 37. In turn, the leveling plate 37 is secured to the support housing 35 by suitable bolts 38 and a pivot pin 39 for basic location and support. A suitable registration bar 40 is also bolted to the support housing 35 just below the leveling plate 37. The registration bar 40 contains jacking screws (not shown) to provide pivotal motion to the leveling plate 37 about the pin 39, and thus to the carriage 16. This bar 40 remains in place after final horizontal alignment. The jacking screws remain in contact to help give support and aid with re-alignment in the event that the leveling plate 37 should be removed any time subsequently.

Referring to FIG. 2, a sensor 41 is mounted on the support plate 25 for sensing the arrival of the carriage 16 in a predetermined fixed position that is, a "home" position, and emitting a responsive signal. Suitable stops (not shown) are nestled between the bellow 31, one at each end, to prevent over travel of the carriage 16; the stop adjacent the sensor 41 being spaced about ¼ inch downstream.

Referring to FIG. 5, the grinding machine 11 is provided with a processing means 42 in the form of a computer or central controller which is connected to the various operating components of the machine to control and coordinate the movements of the various components. To this end, the processing means 42 is connected by a suitable line 43 to the holding means 12 for holding and rotating the wafer during grinding. In addition, the processing means 42 is connected via a suitable line 44 to the motor M for the grinding wheel 14 in order to rotate the grinding wheel. Also, the processing means 42 is connected via a suitable line 45 to the sensor 41 in order to receive a signal therefrom indicating that the carriage 16 has reached the home position.

The processing means 42 is provided with a suitable program so as to produce a wafer with one or more flats and a curvilinear periphery after grinding. To this end, the program for carrying out the grinding operation is initiated when a signal is received from the sensor 41 in cooperation with other relevant signals to proceed. In this respect, once a wafer has been deposited onto the chuck 12, the stepper motor 26 is actuated by the processing means 42 so as to move the carriage 16 to the home position. At this time, a signal from the sensor 41 is emitted to the processing means 42 to begin the grinding operation.

By way of example, to form a wafer W with one flat F as shown in FIG. 6, the program for the grinding operation begins with the stepper motor 26 being activated by the processing means 42 so as to move the carriage 16 away from the sensor 41 a programmed amount so as to grind a flat on the wafer W on the chuck 12. In the event that the grinding wheel 14 is to be moved closer to or farther from the central axis 13, the stepper motor 36 for moving the support housing 35 may be actuated first so as to increment the plane of the carriage 16 towards or away from the central axis 13 of the wafer W before the carriage 16 is moved along the guide rails 23.

During the grinding of the flat F, the chuck 12 is programmed to remain stationary. Thus, the wafer W also remains stationary.

After the flat F has been ground, the processing means 42 actuates the stepper motor 26 so that the stepper motor 26 is reversed to bring the axis of the grinding wheel 14 back into alignment with the central axis 13 of the wafer, W and in a plane perpendicular to the flat and central axis 13, i.e. to the mid-point of the flat. In this position, the motor 36 is actuated to move the carriage 16 away from the wafer a short distance to establish a fixed axis and the chuck 12 is then rotated along with the grinding wheel 14. In this respect, if the periphery is to be circular, the grinding wheel 14 is held on a stationary vertical axis as the wafer W rotates with the chuck 12. However, if another curvature is required, the grinding wheel 14 may be moved toward or away from the central axis 13 of the wafer via a movement of the carriage.

The grinding operation is performed during one revolution of the wafer W.

Referring to FIG. 1, the grinding wheel 14 may be movably disposed within a housing 46 fixed to the frame of the machine 11. In addition, a seal assembly 47 is mounted on a yoke 48 which is also disposed within the housing 46 in fixed relation to the grinding wheel 14. The yoke 48 is, for example, mounted on a rod 49 which passes through a wall of the housing 46 and which is sealed thereto by means of a bellows 50. The rod 49 is mounted by suitable brackets 51 on the support housing 35 which is reciprocally mounted on the rails 33. The seal assembly 47 is constructed in a manner as described in copending application entitled A SEAL ASSEMBLY FOR A WAFER GRINDING MACHINE. In this respect, the seal assembly is provided with a pair of sealing strips between which the wafer W projects for grinding by the wheel 14.

The invention thus provides a flat grind stage assembly for a grinding machine which is capable of producing one or more flats on a ground wafer in a relatively easy and efficient manner.

Further, the invention provides a grind stage assembly which is able to form a flat with a true and accurate straight edge.

What is claimed is:

1. A flat grind stage assembly for a grinding machine comprising holding means for rotating a wafer on a fixed axis;

a grinding wheel for grinding a peripheral edge of the wafer;

first means for moving said grinding wheel along a first axis perpendicular to said fixed axis of the wafer for grinding the edge of the wafer during rotation thereof; and second means for moving said grinding wheel along a second axis perpendicular to said first axis for grinding at least one flat on the edge of the wafer with the wafer in a stationary position.

2. An assembly as set forth in claim 1 which further comprises a processing means connected with said holding means, said first means and said second means for actuating said first means and said second means to grind the peripheral edge of a rotating wafer into a circular shape with at least one flat.

3. An assembly as set forth in claim 2 wherein said processing means is connected to said holding means to stop rotation of the wafer during movement of said grinding wheel along said second axis.

4. In a automatic grinding machine, the combination comprising a grinding wheel for grinding a peripheral edge on a wafer;

a housing having said grinding wheel rotatably mounted therein on a first axis;

a carriage having said housing secured thereto;

first means for moving said carriage along a first path in a plane spaced from and parallel to said first axis to move said grinding wheel along the peripheral edge of a wafer to form a flat thereon; and second means for moving said carriage along a second path perpendicular to said first path and intersecting with said first axis to move said grinding wheel into engagement with the peripheral edge of a rotating wafer to form a curvilinear edge thereon.

5. An automatic grinding machine as set forth in claim 4 wherein said first axis is a vertical axis and each said path is horizontally disposed.

6. An automatic grinding machine as set forth in claim 4 wherein said first means includes a pair of horizontally disposed parallel guide rails guiding said carriage thereon and a stepper motor connected to said carriage for moving said carriage along said guide rails.

7. An automatic grinding machine as set forth in claim 6 which further comprises a sensor disposed in a predetermined fixed position relative to said guide rails for sensing arrival of said carriage thereat and for emitting a signal in response thereto.

8. An automatic grinding machine as set forth in claim 7 which further comprises a processing means connected to said stepper motor and said sensor for actuating said stepper motor to move said carriage to said fixed position at the beginning of a grinding operation and for thereafter actuating said stepper motor to move said carriage a programmed amount away from said sensor to form a flat on a peripheral edge of a wafer.

9. An automatic grinding machine as set forth in claim 6 wherein said first means includes a rotatable screw rotatably connected to said motor for rotation thereby and threaded into said carriage in rotatable relation.

10. An automatic grinding machine as set forth in claim 6 wherein said second means includes a pair of horizontally disposed parallel support rails, a support housing mounted on said support rails and having said first means secured thereto, and a second motor connected with said support housing for moving said support housing along said support rails.

11. An automatic grinding machine as set forth in claim 10 which further comprises a sensor disposed in a predetermined fixed position relative to said guide rails for sensing arrival of said carriage thereat and for emitting a signal in response thereto.

12. An automatic grinding machine as set forth in claim 11 which further comprises a processing means connected to said stepper motor and said sensor for actuating said stepper motor to move said carriage along said guide rails to said sensor at the beginning of a grinding operation and for thereafter actuating said stepper motor to move said carriage along said guide rails a programmed amount away from said sensor to form a flat on a peripheral edge of a wafer, said processing means being connected to said second motor to actuate said second motor after formation of a flat to move said grinding wheel relative to the wafer to grind a curvilinear peripheral edge thereon.

13. An automatic grinding machine as set forth in claim 4 which further comprises a stationary housing having said grinding wheel movably disposed therein in sealed relation.

14. An automatic grinding machine as set forth in claim 13 which further comprises means for directing a flow of coolant into said housing adjacent said grinding wheel.

15. An automatic grinding machine comprising holding means for positioning a wafer on a fixed axis of rotation;

a grinding wheel for grinding a peripheral edge on a held wafer;

a carriage having said grinding wheel rotatably mounted thereon;

first means for moving said carriage along a first path in a plane spaced from and parallel to said fixed axis to move said grinding wheel along the edge of the wafer to form a flat thereon; and second means for moving said carriage along a second path perpendicular to said first path and intersecting with said first axis to move said grinding wheel into engagement with the peripheral edge of a rotating wafer to form a curvilinear edge thereon.

16. An automatic grinding machine as set forth in claim 15 which further comprises a processing means connected with said holding means, said first means and said second means for actuating said first means to form a flat on the wafer and thereafter actuating said holding means and said second means to rotate the wafer while forming a curvilinear periphery thereon.

17. An automatic grinding machine as set forth in claim 16 which further comprises a sensor disposed in a predetermined fixed position relative to said first path for sensing arrival of said carriage thereat and for emitting a signal in response thereto.

18. An automatic grinding machine as set forth in claim 17 wherein said processing means is connected to said sensor to actuate said first means to move said carriage to said sensor at the beginning of a grinding operation and to thereafter actuate said first means to move said carriage a programmed amount away from said sensor along said first path to form a flat on the wafer.

19. An automatic grinding machine as set forth in claim 18 wherein said first means includes a pair of horizontally disposed parallel guide rails guiding said carriage thereon and a stepper motor connected to said carriage for moving said carriage along said guide rails.

20. An automatic grinding machine as set forth in claim 18 which further comprises a stationary housing having said grinding wheel movably disposed therein in sealed relation.

21. In a automatic grinding machine, the combination comprising holding means for holding a wafer on a fixed axis;

a grinding wheel for grinding a peripheral edge on the wafer;

a housing having said grinding wheel rotatably mounted therein on a first axis;

a carriage having said housing secured thereto;

first means for moving said carriage from a defined "home" position along a first path in a plane spaced from and parallel to said first axis to move said grinding wheel along the peripheral edge of a wafer to form a flat thereon and to thereafter reverse said carriage to move said grinding wheel to a mid-point of the flat; and second means for moving said carriage along a second path perpendicular to said first path and intersecting with said first axis to move said grinding wheel into engagement with the peripheral edge of a rotating wafer to form a curvilinear edge thereon.

22. An automatic grinding machine as set forth in claim 21 wherein said first axis is a vertical axis and each said path is horizontally disposed.

23. An automatic grinding machine as set forth in claim 21 which further comprises a sensor disposed in a predetermined fixed position for sensing arrival of said carriage at said "home" position and for emitting a signal in response thereto.

24. An automatic grinding machine as set forth in claim 23 which further comprises a processing means connected to said first means and said sensor for actuating said first means to move said carriage to said fixed position at the beginning of a grinding operation and for thereafter actuating said first means in response to said signal to move said carriage a programmed amount away from said sensor to form a flat on a peripheral edge of a wafer.

25. A method of grinding a wafer comprising the steps of holding a wafer on a fixed axis;

moving a grinding wheel along a first path in a plane spaced from and parallel to said fixed axis to move said grinding wheel against the edge of the wafer to form a flat thereon;

thereafter moving said grinding wheel along said first path in a reverse direction to a mid-point of the flat; and moving said grinding wheel along a second path perpendicular to said first path and intersecting with said fixed axis to position said grinding wheel in spaced relation to the flat; and thereafter rotating the wafer while engaging said grinding wheel with the edge thereof to form a curvilinear edge thereon.

* * * * *

UNITED STATES PATENT AND TRADEMARK OFFICE

CERTIFICATE OF CORRECTION

PATENT NO. : 5,076,021

DATED : Dec. 31, 1991

INVENTOR(S) : ROBERT E. STEERE, JR.

It is certified that error appears in the above-identified patent and that said Letters Patent is hereby corrected as shown below:

Column 2, line 14 change "predetermine" to -predetermined-

Column 3, line 3 change "638,601" to --4,638,601.--

Signed and Sealed this

Twenty-seventh Day of April, 1993

*Attest:*

MICHAEL K. KIRK

*Attesting Officer*

*Acting Commissioner of Patents and Trademarks*